US008016521B1

(12) United States Patent
Krabbendam

(10) Patent No.: US 8,016,521 B1
(45) **Date of Patent: *Sep. 13, 2011**

(54) METHOD FOR DEPLOYING A DEEPWATER MOORING SPREAD

(75) Inventor: Richard L. Krabbendam, Rotterdam (NL)

(73) Assignee: Kahn Offshore, B.V., Rotterdam (NL)

( * ) Notice: Subject to any disclaimer, the term of this patent is extended or adjusted under 35 U.S.C. 154(b) by 318 days.

This patent is subject to a terminal disclaimer.

(21) Appl. No.: 12/357,967

(22) Filed: Jan. 22, 2009

(51) Int. Cl.
*E02D 11/00* (2006.01)

(52) U.S. Cl. ..... 405/228; 405/224; 405/232; 405/249

(58) Field of Classification Search ..... 405/154.1, 405/158, 224, 228, 231, 232, 244, 249
See application file for complete search history.

(56) References Cited

U.S. PATENT DOCUMENTS 6,457,908 B1 * 10/2002 Bergeron ..... 405/224

FOREIGN PATENT DOCUMENTS

EP 0059648 * 8/1982

* cited by examiner

*Primary Examiner* — Sunil Singh
*Assistant Examiner* — Sean Andrish
(74) *Attorney, Agent, or Firm* — Buskop Law Group, PC; Wendy Buskop

(57) ABSTRACT

A method for deploying a deepwater mooring spread from a floating vessel with a bow, stern, hull, deck, and aft crane secured to a port side or a starboard side of the hull having a hold, and a fore crane secured to the port side or starboard side of the hull. To lower heavy suction piles or other structures to almost unlimited water depths, the crane tackle after a depth of approximately 1000 meters is replaced using the polymer lines as a temporary lifting pennant with almost neutral buoyancy and therefore no extra weight is added to the lifting tackle of the crane.

7 Claims, 13 Drawing Sheets

FIGURE 5A
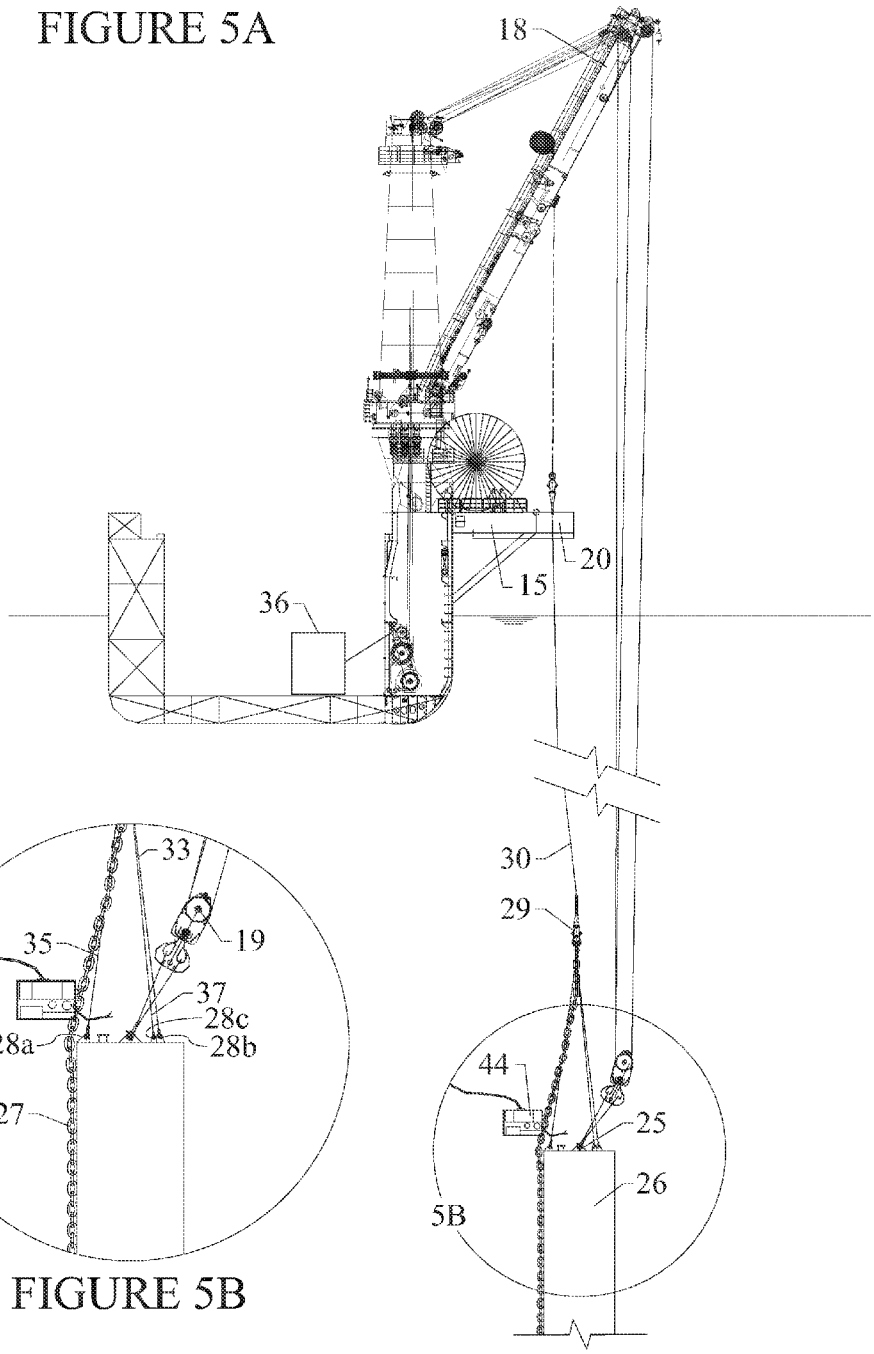
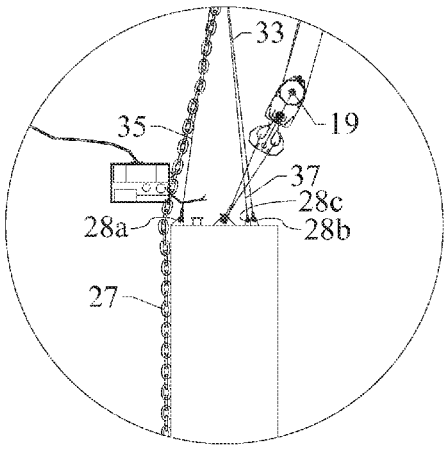
FIGURE 5B

REPLACEMENT SHEET
FIGURE 6A
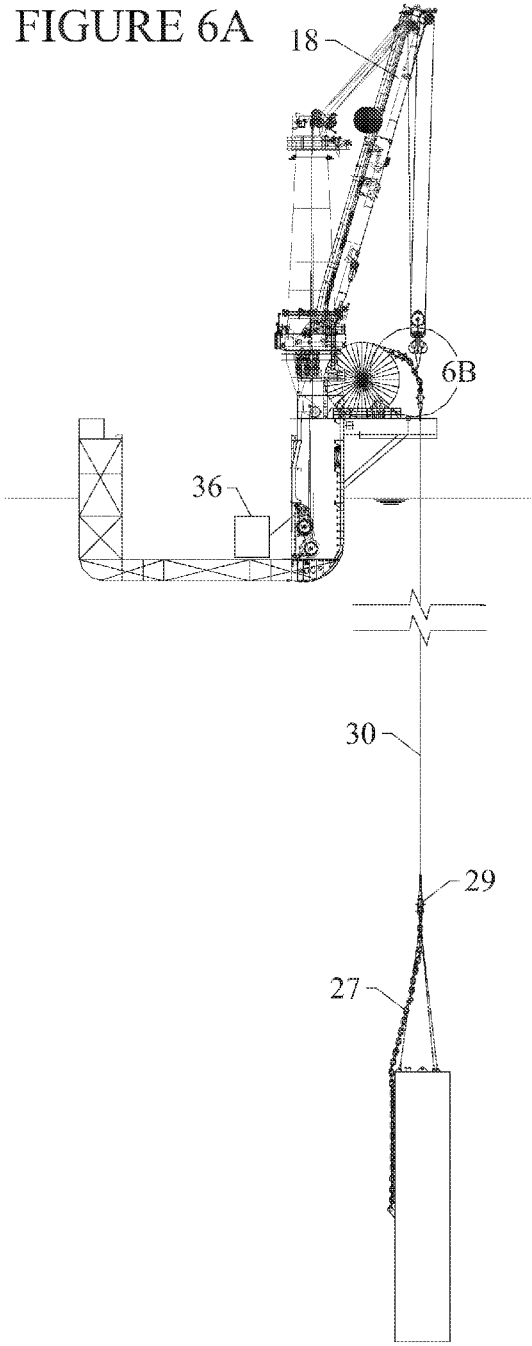
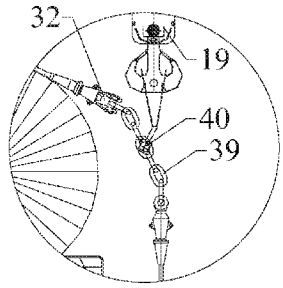
FIGURE 6B

METHOD FOR DEPLOYING A DEEPWATER MOORING SPREAD

FIELD

The present embodiments relate to a method for deploying a mooring spread in deep water using anchors such as suction piles onto a sea floor wherein the water depth can exceed 1000 meters.

BACKGROUND

A need exists for a method for deploying a deepwater, over 1000 meter mooring spread from a floating vessel with using two cranes that is fast, safe, and easy to perform.

A deepwater deployment system is described in Applicant's U.S. Pat. No. 6,964,552 and is incorporated herein by reference.

A further need exists for a method for deploying suction piles using polymer lines that provide a neutral buoyancy. A further need exists for a method that can deploy heavy structures to almost unlimited water depths using a polymer line as a temporary lift pennant, the lift pennant could be a mooring line as well.

The present embodiments meet these needs.

BRIEF DESCRIPTION OF THE DRAWINGS

The detailed description will be better understood in conjunction with the accompanying drawings as follows:

FIGS. 5A-5B show a schematic of a floating vessel with the first polymer line connected to the hang-off fully supporting the suction pile.

FIGS. 6A-6B show a schematic of a floating vessel with a chain segment connected between the first polymer line and a second polymer line, creating the mooring line.

Figure 1:
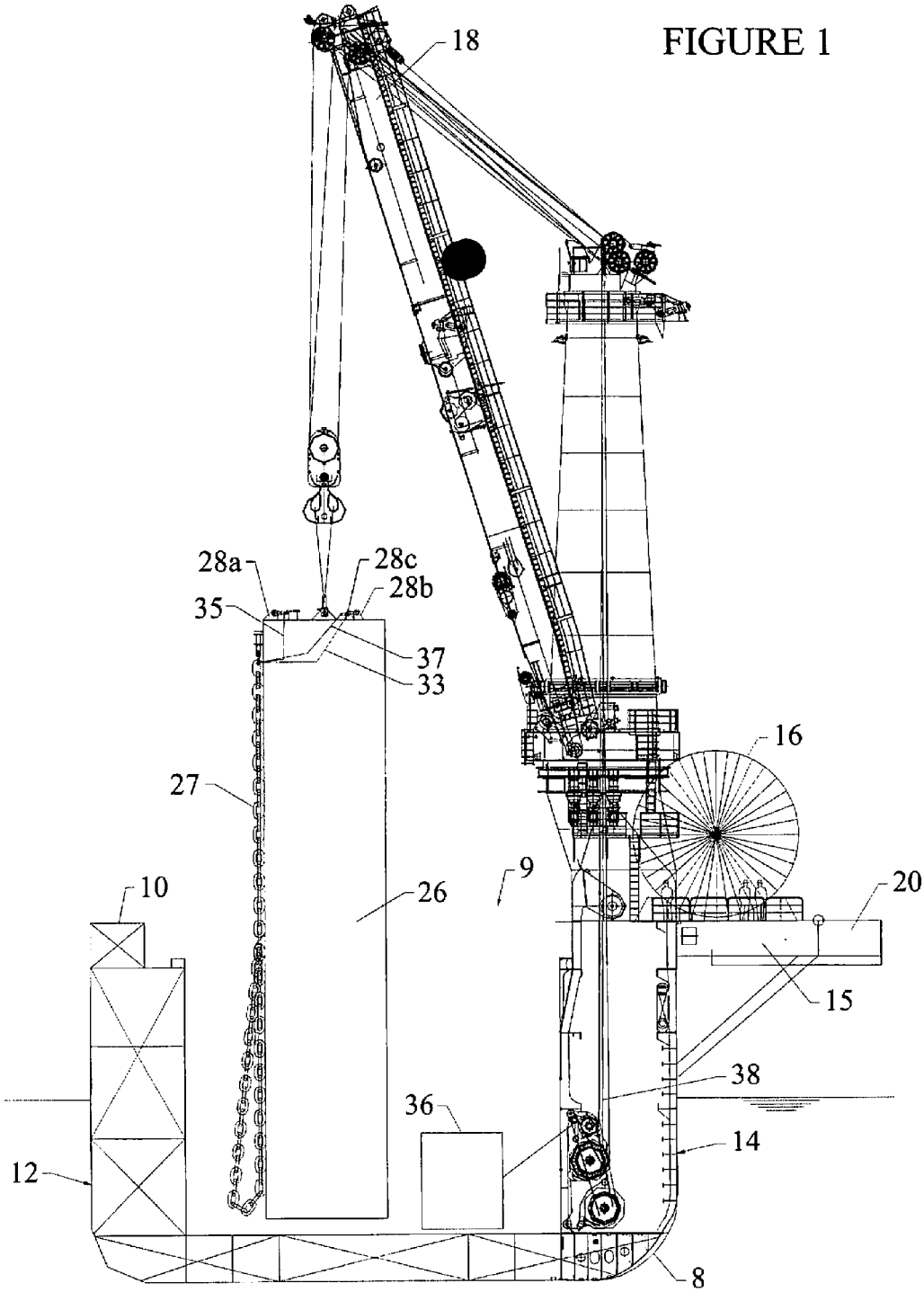
FIG. 1 is a schematic of a floating vessel using the method wherein an aft crane has lifted a suction pile from the hold of a floating vessel.

The present embodiments are detailed below with reference to the listed Figures.

DETAILED DESCRIPTION OF THE EMBODIMENTS

Before explaining the present method in detail, it is to be understood that the method is not limited to the particular embodiments and that it can be practiced or carried out in various ways.

The present embodiments generally relate to a method for deploying a deepwater mooring spread from a floating vessel with a deck, using an aft crane secured to a port side or a starboard side of the floating vessel, and a fore crane secured to the port side or starboard side of the floating vessel. The floating vessel can be a heavy lift vessel.

One of the benefits of this method is the ability to deploy heavy structures to almost unlimited water depths by using a polymer line as a temporary lift pennant, the lift pennant can be a mooring or polymer line as well.

The method can involve first connecting a suction pile, such as a first anchor, to a lifting block of the aft crane while the suction pile or anchor is in a hold or on a deck of the floating vessel in a vertical or a horizontal position.

Next, a reel drive can be fixedly connected to a load bearing structure affixed to an outboard port side or an outboard starboard side of the floating vessel and can be used for deployment of polymer lines. The load bearing structure can be a tween deck hatch cover or any other structure. A hang-off for connecting to the polymer line can be located on the load bearing structure.

A suction pile can then be lifted with the aft crane from the hold. It should be noted that each suction pile can have a suction pile anchor chain connected to a pad eye at the lower end of the suction pile at one end, and at the other end outfitted with a remote operated connector, which in turn engages the chain which is supported at the top side of the suction pile.

The suction pile can then be lifted by the aft crane outboard of the floating vessel.

The polymer line can be connected to the suction pile anchor chain and then the polymer line can be deployed while the aft crane lowers the suction pile into the water.

It should be noted that the polymer line can be deployed using the reel drive simultaneously while lowering the suction pile to a first depth using the aft crane.

Once fully paid out, the end of the deployed first polymer line can then be connected to the hang-off attached to the load bearing structure.

The aft crane can then transfer the weight of suction pile from the aft crane to the first polymer line supported by the hang-off on the load bearing structure.

The aft crane main block can then be released from the suction pile such as using a remote operated connector, which can then suspend the suction pile from the first polymer line connected to the hang-off. The aft crane main block can then be retrieved to the deck of the floating vessel.

A second polymer line can be connected to the first polymer line at the deck level. The second polymer line can then be deployed by the reel drive.

The first polymer line with the load of the suction pile can be lifted by the aft crane while the second polymer line without a load can be connected to the first polymer line.

The second polymer line can then be deployed using the reel drive while the aft crane lowers the suction pile and first polymer line combination to a second depth. A deepwater deployment system connected to the aft crane can be used to facilitate this movement into deeper water.

The end of the second polymer line can then be connected to the hang-off of the load bearing structure.

The aft crane can then transfer the load of the first polymer line with the suction pile to the second polymer line connected to the hang-off. The aft crane main block can then be retrieved to the deck.

Additional polymer lines can be connected, deployed and load transferred to them in a similar manner until the suction pile reaches the sea floor.

Next a first buoy with a first buoy chain can then be lifted from the hold or deck of the floating vessel with the fore crane.

The fore crane can then orient the first buoy adjacent to an end of the last installed polymer line connected to the hang-off.

The first buoy is overboarded from the floating vessel using the fore crane and the first buoy chain can then be connected to the end of the last polymer line secured to the hang-off.

The last connected polymer line with the suction anchor load can then be removed from the hang-off by the aft crane.

The suction pile can then be lowered by the aft crane and allowed to penetrate into the sea floor using its own weight. It can also be lowered with the fore crane to penetrate into the sea floor, after the load has been transferred from the aft crane to the fore crane.

A remote operated vehicle (ROV) can then be used to penetrate the suction pile further into the sea floor by pumping entrapped water from the suction pile.

The polymer lines now without a load but still attached to the suction pile are now supported by the floating first buoy and the crane main blocks can then be returned to the deck.

The polymer line can be a fiber line of any kind with a density close to the density of seawater.

The method can be used on between 1 suction pile to 18 suction piles for deployment to a water depth of at least 1000 meters.

A remote operated shackle can be used with each suction pile for lifting the suction pile using the aft crane main block.

At least one top connector can be used with each suction pile.

An embodiment contemplates that a plurality of suction piles can be disposed in a hold in a vertical orientation of the floating vessel, or in a horizontal or a vertical position on the deck of another floating vessel.

An embodiment contemplates that a heave compensator can be used to control load movement using one or both cranes while orienting and lowering the suction pile.

Turning now to the Figures, FIG. 1 shows a schematic of a floating vessel usable in the method for deploying deep water moorings for water depths ranging from about 50 meters to about 1500 meters or more.

A floating vessel 8, is shown with a hold 9 which can accommodate a suction pile 26. Additional suction piles and anchors can be accommodated in the hold 9. In addition, the suction piles can be oriented horizontally or vertically.

The floating vessel can have a length between about 60 meters to about 400 meters and a weight between about 3000 tons to about 50,000 tons.

More than two suction piles can be supported in the hold of the floating vessel 8.

In an embodiment the suction piles or anchors can be on the deck 10 of the floating vessel 8, which can be a heavy lift ship with bow and stern, a barge with cranes with or without propulsion, or another types of movable vessels.

In this embodiment, the suction piles can be vertically arranged in the hold for ease of lifting by cranes secured to the starboard side or port side of the hull of the floating vessel 8.

Each suction pile 26 or anchor can have a suction pile anchor chain 27. Any number can be deployed as long as all the suction piles or anchors fit on or in the floating vessel and any suction pile can be used with this method.

Figure 2:
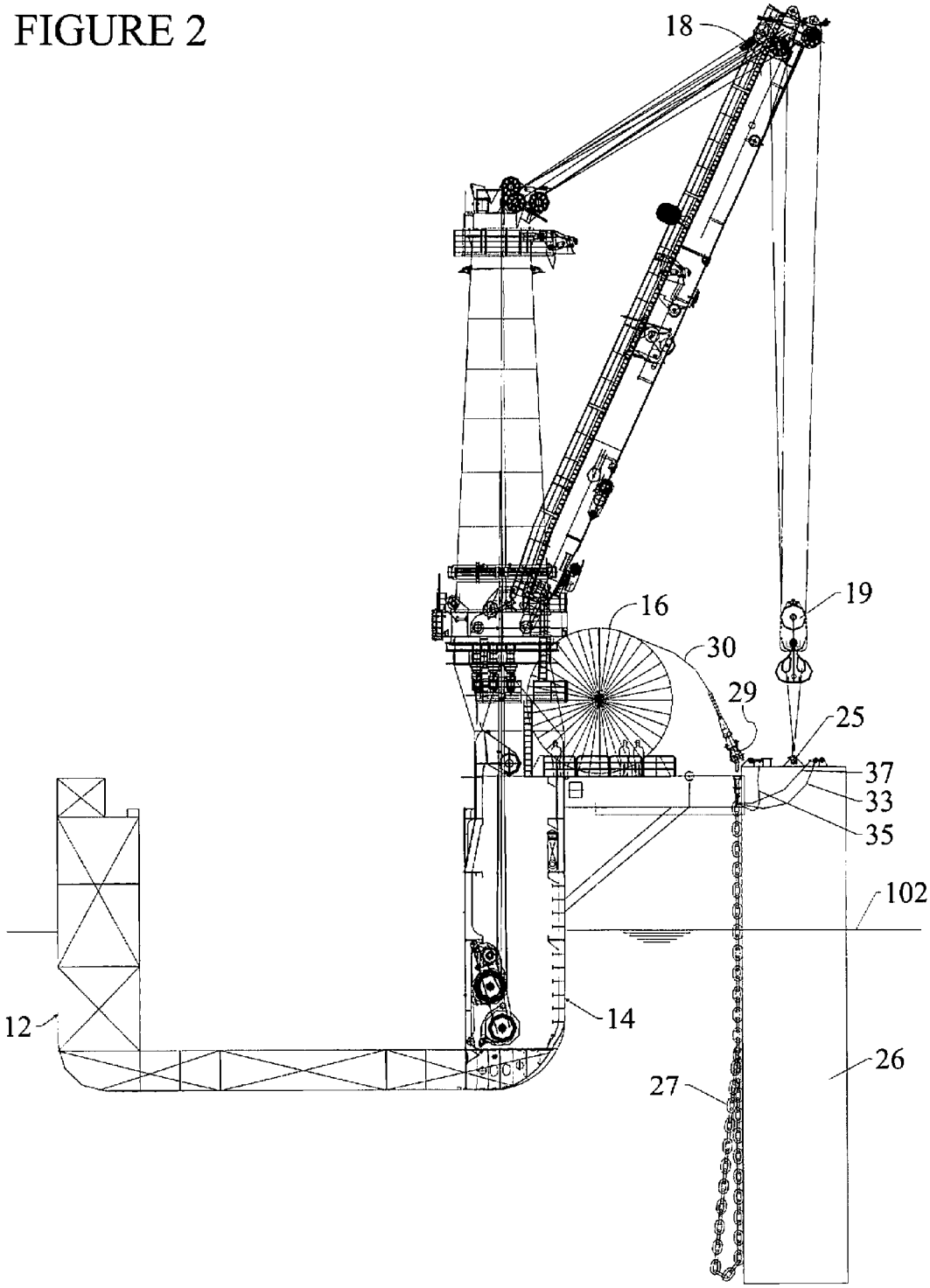
FIG. 2 is a schematic of a floating vessel with the suction pile overboarded into water supported by the aft crane and connected to one end of a first polymer line.
Figure 12:
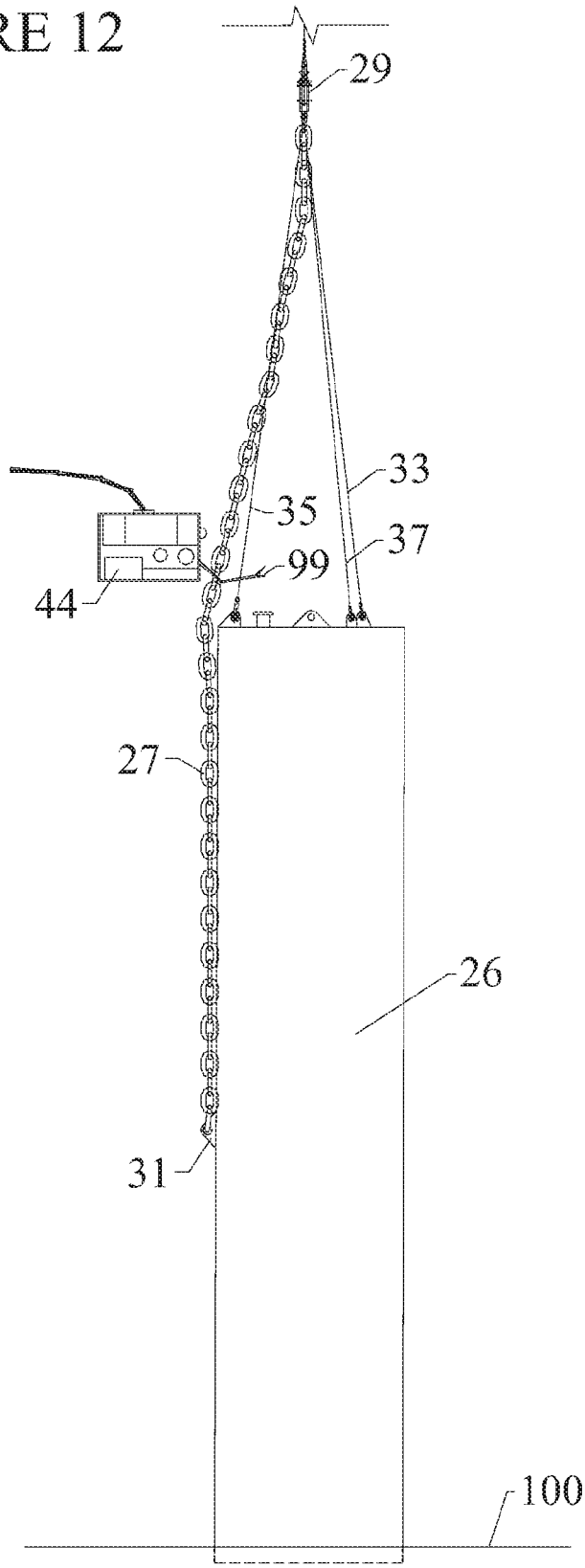
FIG. 12 shows the suction pile sunk into the sea floor under its own weight with an remote operated vehicle "ROV" for pumping water out of the suction pile.

Each suction pile anchor chain 27 can be connected with a side pad eye 31, shown in more detail in FIG. 12, at the lower side of the suction pile 26, or anchor. At the other side of the suction pile anchor chain 27 can be a remote operated connector 29, which can connect the suction pile anchor chain 27 to the polymer line, which is shown in FIG. 2.

The suction piles, in an embodiment, can have three pad eyes 28*a*, 28*b* and 28*c*. To these pad eyes can be connected a first lift sling 33, a second lift sling 35 and a third lift sling 37, which can be connected to the end of the suction pile anchor chain 27.

The floating vessel has two cranes, a fore crane not shown in this FIG. 1 and an aft crane 18. The order of use of the cranes can be reversed in another embodiment of this method.

These cranes can be pedestal cranes or mast cranes such as those made by Huisman-Itrec located near Rotterdam, the Netherlands or any other manufacturer. The cranes notably have the features of being able to lower loads to water depths of at least 800 meters by use of a deepwater deployment system, comprised of a winch in the lower hold with the lifting wire of between about 2000 meters to about 25000 meters guided via sheaves to the jib head of the crane and lift tackle.

FIG. 1, further shows the deepwater deployment system 36 with deepwater deployment line 38. The deepwater deployment line can further be a lifting wire.

A load bearing structure 15 can be connected to an outboard starboard side 14 in FIG. 1. However, in another embodiment, the load bearing structure 15 can be connected to an outboard port side 12 if at least one crane was located on the port side of the floating vessel 8.

Secured to the load bearing structure 15 can be a hang-off 20 for securing, removably, one or more polymer lines deployed with this method. The load bearing structure 15 can be a steel plate that can be reinforced with steel brackets. For example, the load bearing structure 15 can be a perforated steel plate that can be powder coated having a length of between about 6 meters to about 20 meters, a width of between about 2 meters to about 10 meters and a thickness of between about 0.5 meters to about 1.5 meters, such as a tweendeck hatch cover or any other load bearing structure. The hang-off can further be any hang off element.

A reel drive 16 can be fixedly secured to the load bearing structure 15. The reel drive 16 can be used for deploying at least one, and up to 6 polymer lines for a single mooring line.

FIG. 2 shows the aft crane 18 having lifted the suction pile 26 from the hold and partially lowered into water 102 on the starboard side of the floating vessel.

In this FIG. 2, a first polymer line 30 is shown coming off the reel drive 16.

The aft crane main block 19 is shown supporting the suction pile 26 at the first remote operated shackle 25.

The first polymer line 30 is shown connected while the suction pile top is out of the water, to remote operated connector 29 while the suction pile anchor chain 27 is shown connected to the first lift sling 33, the second lift sling 35 and third lift sling 37.

Figure 3:
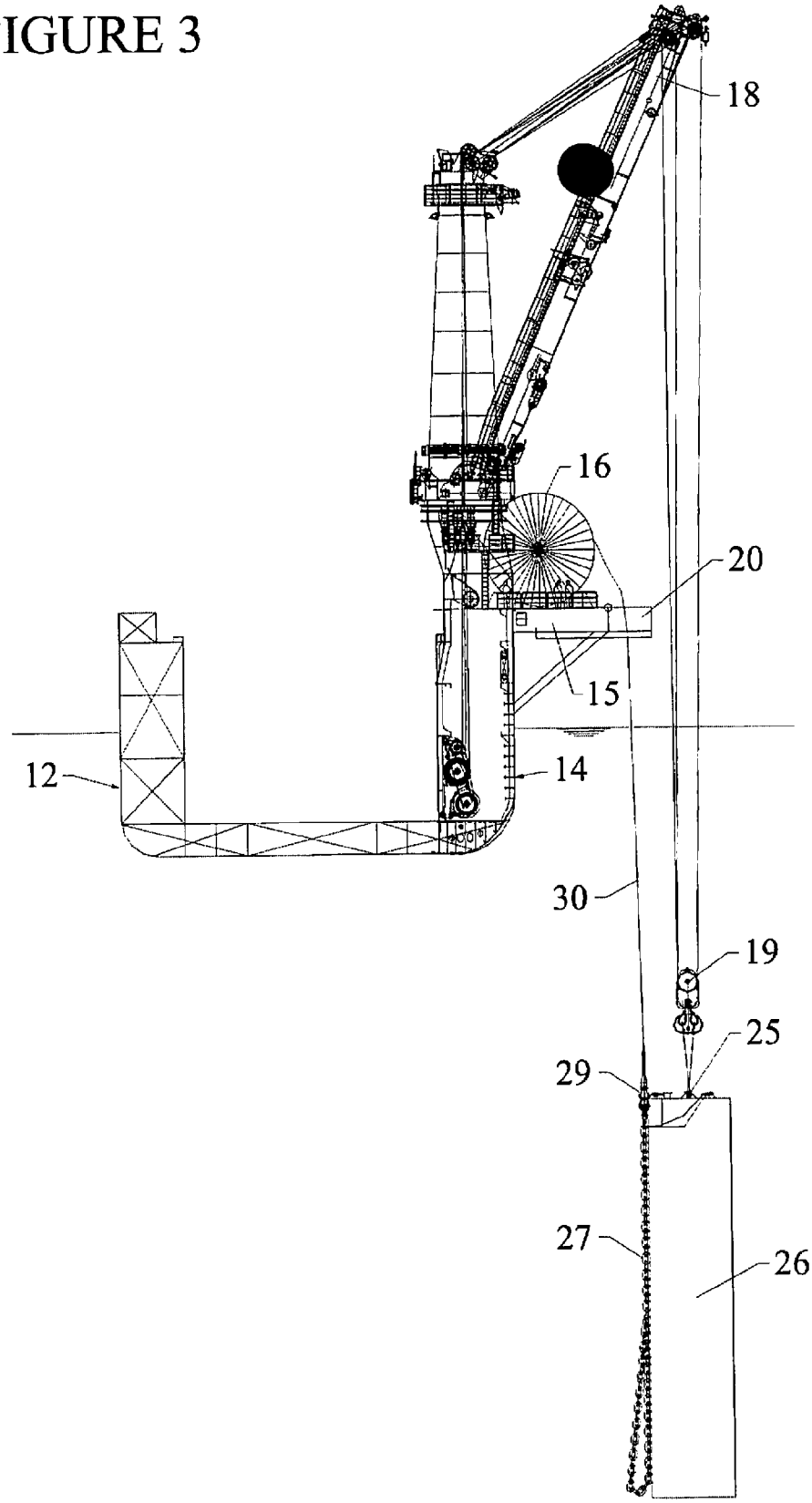
FIG. 3 shows a schematic of a floating vessel with the suction pile lowered into the water connected to the first polymer line.

FIG. 3 shows the suction pile 26 being lowered by the aft crane 18 into the water 102, below the water line towards the sea floor, which is not shown in this Figure. The suction pile is lowered by the aft crane main block 19. Simultaneously while the suction pile 26 is lowered, the reel drive 16 deploys the first polymer line 30 with one end connected to the remote operated connector 29.

Figure 4:
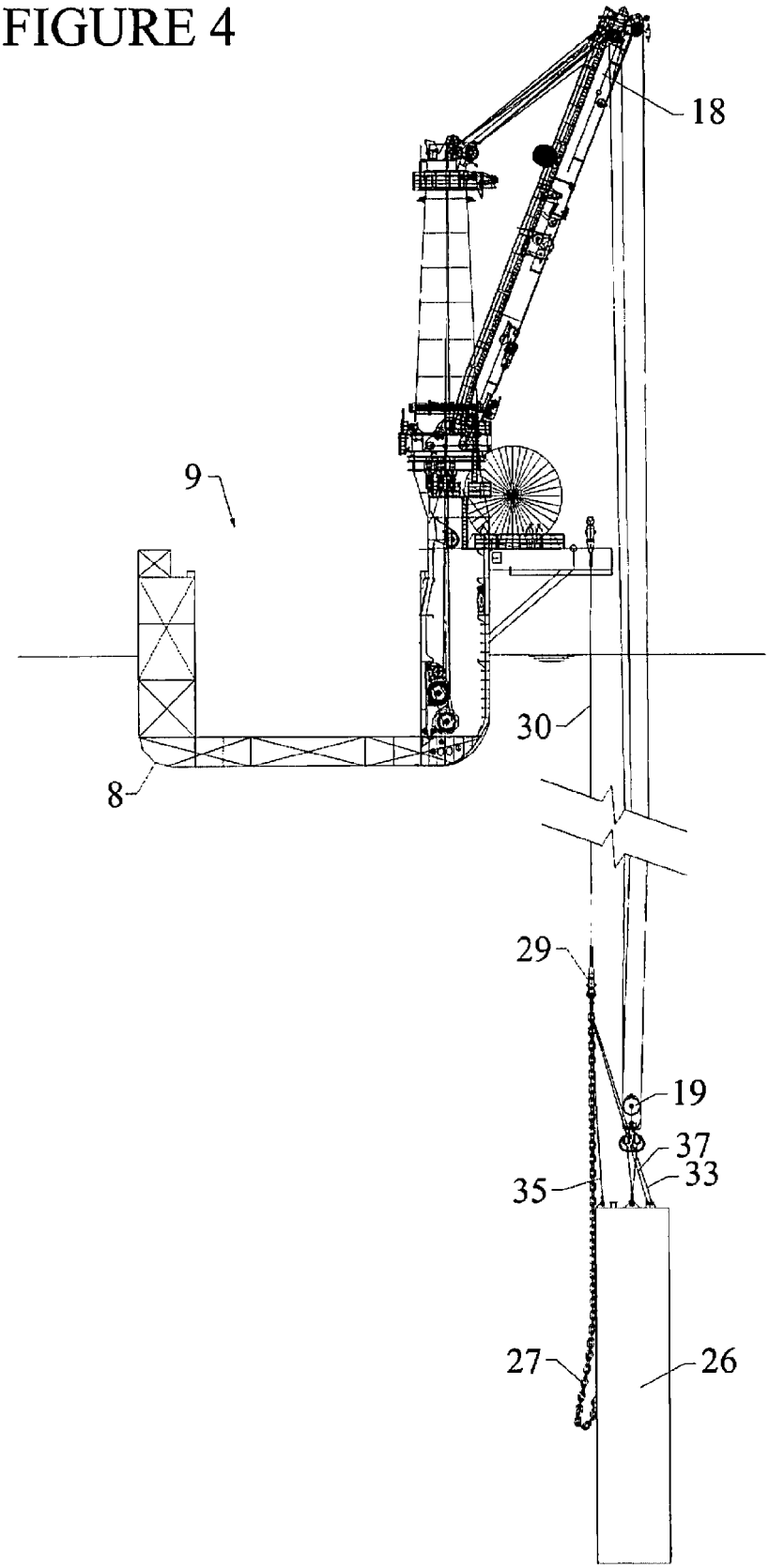
FIG. 4 shows a schematic of a floating vessel with the load from the aft crane being transferred to the first polymer line connected to the hang-off on the load bearing structure.

FIG. 4 shows the suction pile 26 having reached the end of the first polymer line 30 fully deployed, such as about 1000 meters.

FIG. 4 also shows the first lift sling 33, the second lift sling 35 and the third lift sling 37 now extended while secured to the suction pile anchor chain 27, At this point, a transfer of load occurs from the aft crane main block 19 of the aft crane 18 to the first polymer line 30.

FIGS. 5A-5B show the aft crane 18 with the aft crane main block 19 going slack allowing the remote operated connector 29 to support the load, shown as suction pile 26.

A remote operated vehicle 44 is shown for disengaging the aft crane main block 19 from the suction pile's first remote operated shackle 25. The three pad eyes 28*a*, 28*b* and 28*c* are shown connected a first lift sling 33, a second lift sling 35 and a third lift sling 37, for supporting the suction pile anchor chain 27 is depicted as well as the first remote operated connector 29 for use with the suction pile anchor chain 27.

It should be noted that the end of the first polymer line 30 is secured to the hang-off 20 prior to allowing the aft crane main block 19 going slack so that the hang-off can support the load from the first polymer line.

FIGS. 6A-6B show aft crane 18 with a second polymer line 32 being connected to the first polymer line 30 with a chain of the polymer line 39 and a second remote operated shackle 40, which is further shown connected to the aft crane main block 19.

Figure 7:
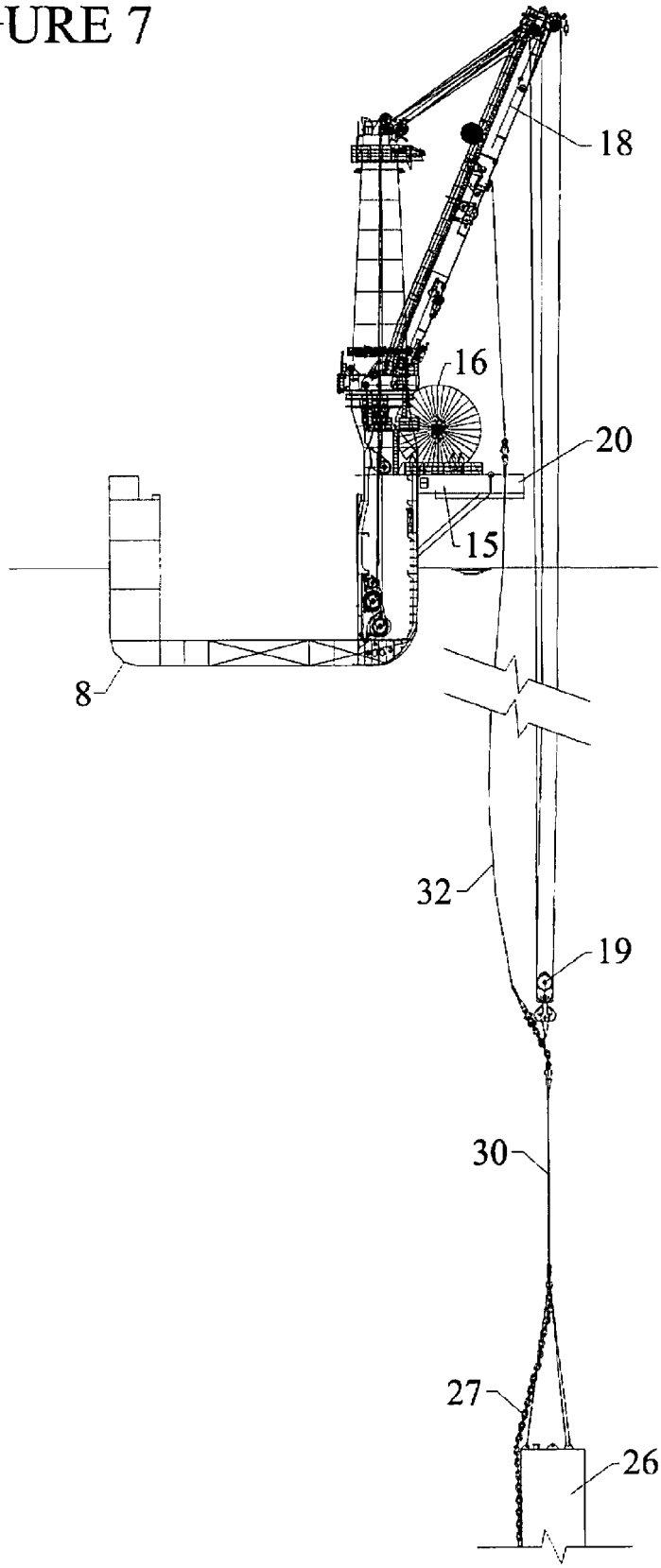
FIG. 7 depicts a schematic of a floating vessel having deployed the second polymer line and the suction pile still supported by the first polymer line connected to the aft crane main block.

FIG. 7 shows the second polymer line 32 deployed from the reel drive 16 and the end of the second polymer line 32 secured to the hang-off 20 on the load bearing structure 15 while the load is off the first polymer line 30 with suction pile 26 still supported by the aft crane main block 19 of the aft crane 18. The reel drive is adapted to first deploy a first polymer line and then deploy a second polymer line in series.

When the required depth has been reached, the end socket of the second polymer line 32 is taken from the reel drive 16. With an auxiliary hoist, the end socket of the second polymer line is placed in the hang-off 20 on the structure. Gradually the suction anchor is lowered with the aft crane main block and the load is transferred to the second polymer mooring line 32 and placed in the hang-off 20.

Figure 8:
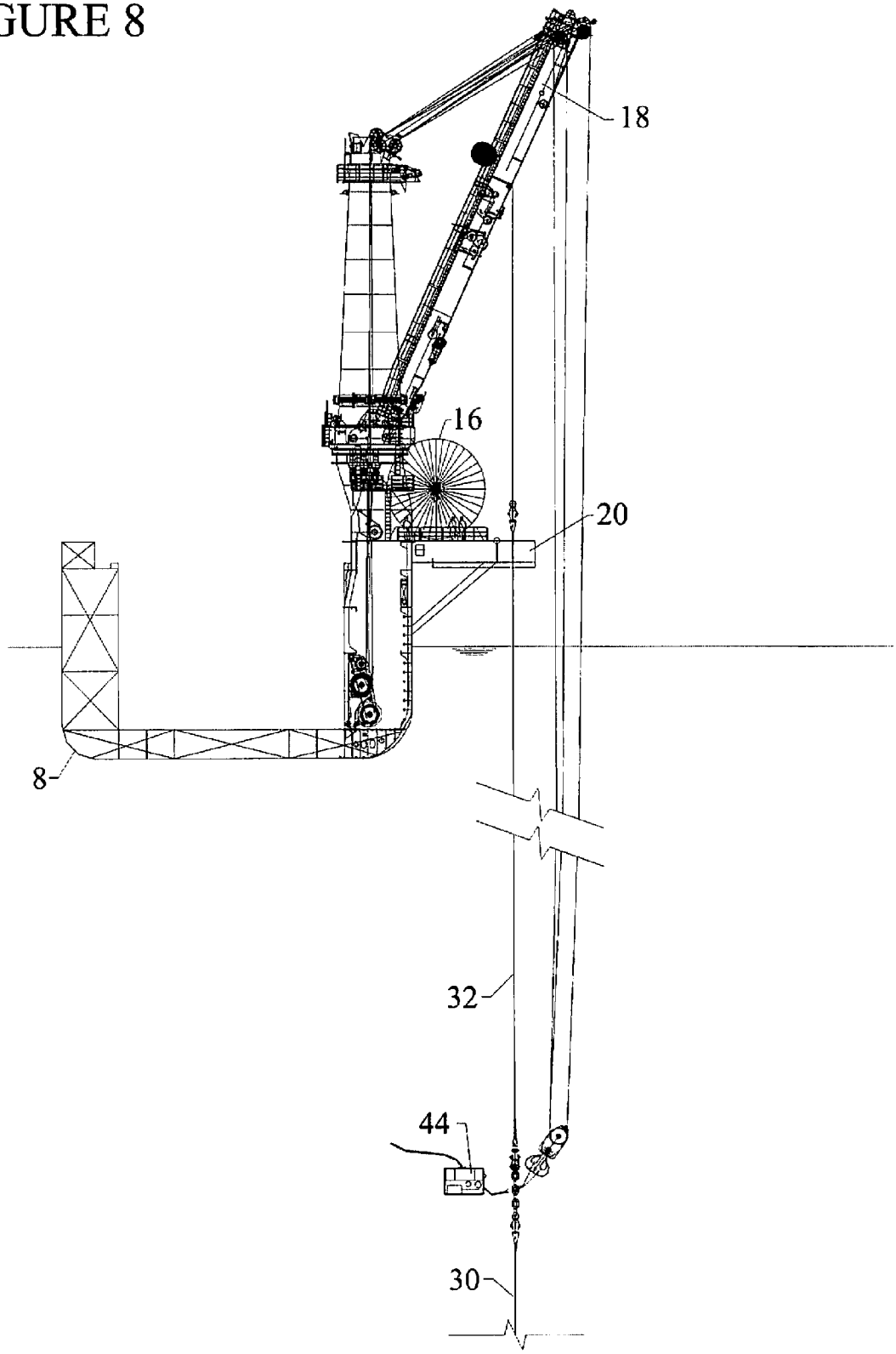
FIG. 8 depicts a schematic of a floating vessel showing the aft crane main block being disconnected from the second polymer line with a remote operated shackle.

FIG. 8 shows the weight now being transferred to the hang-off 20 and the aft crane main block being slack for disconnecting from the chain by a remote operated vehicle, which was shown in greater detail in previous Figures.

Figure 9:
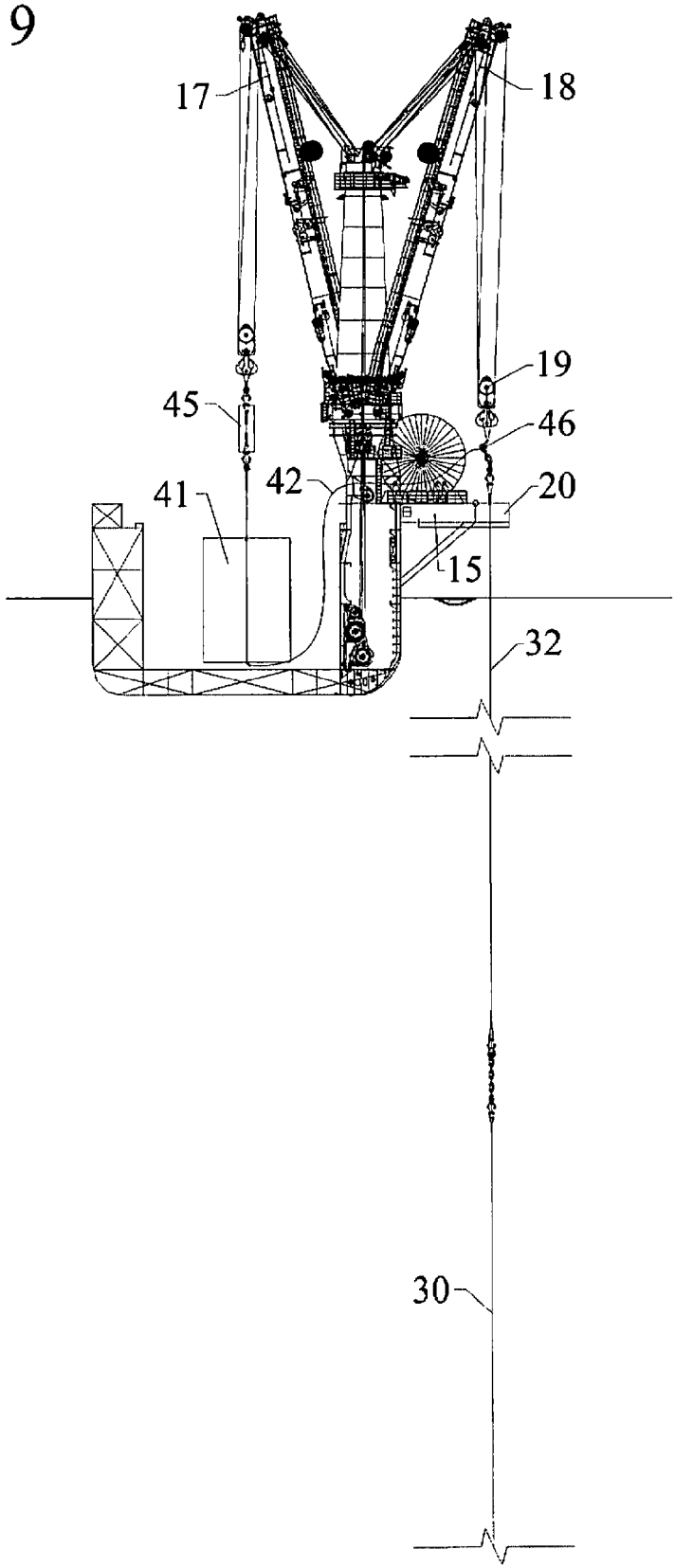
FIG. 9 is a schematic of a floating vessel showing the aft crane being connected to the second polymer line connected in series to the first polymer line enabling the buoy chain to connect to the end of the second polymer line, and a fore crane lifting a buoy from the hold with a heave compensator between the lift rigging and the buoy.

FIG. 9 shows two cranes, the aft crane 18 and the fore crane 17. The fore crane 17 is shown lifting a buoy 41 from the hold of the floating vessel with a heave compensator 45 while a buoy chain 42 engaged to a buoy connector 46 is connected to the end of the load supporting second polymer line 32 that is secured to the hang-off 20. In this Figure, a connection is made between the buoy chain and the second polymer mooring line. The heave compensator can be installed in the lift rigging, if required by the rolling of the sea. The fore crane lifts the buoy out of the hold of the vessel.

Figure 10:
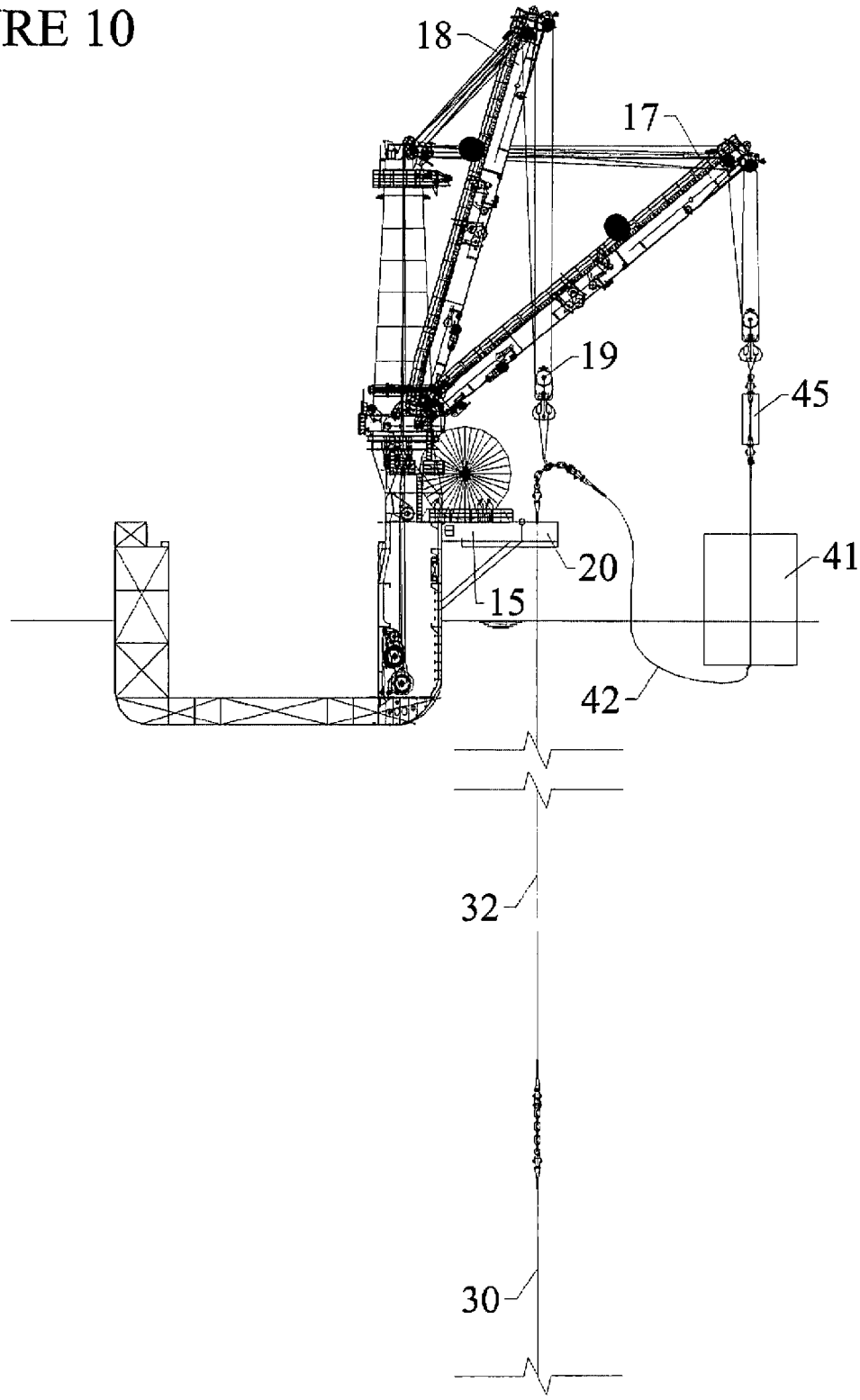
FIG. 10 is a schematic of a floating vessel showing the fore crane overboarding the buoy while connected to the second polymer line and the aft crane lifting the second polymer line from a hang-off on the load bearing structure simultaneously.

FIG. 10 shows the fore crane 17 having overboarded the buoy 41 and slewed it near the hang-off 20. The aft crane 18 is used to lift the first polymer line 30 out of the hang-off 20 while supporting the load of the second polymer line 32. In an embodiment, this occurs simultaneously. That is, the fore crane 17 slews the buoy 41 close to the second polymer line 32 and the aft crane 18. The second polymer line 32 is lifted with the first polymer line 30 and suction pile and suction pile anchor chain connected to it out of the hang-off 20 while the aft crane 17 lowers the buoy 41.

Figure 11:
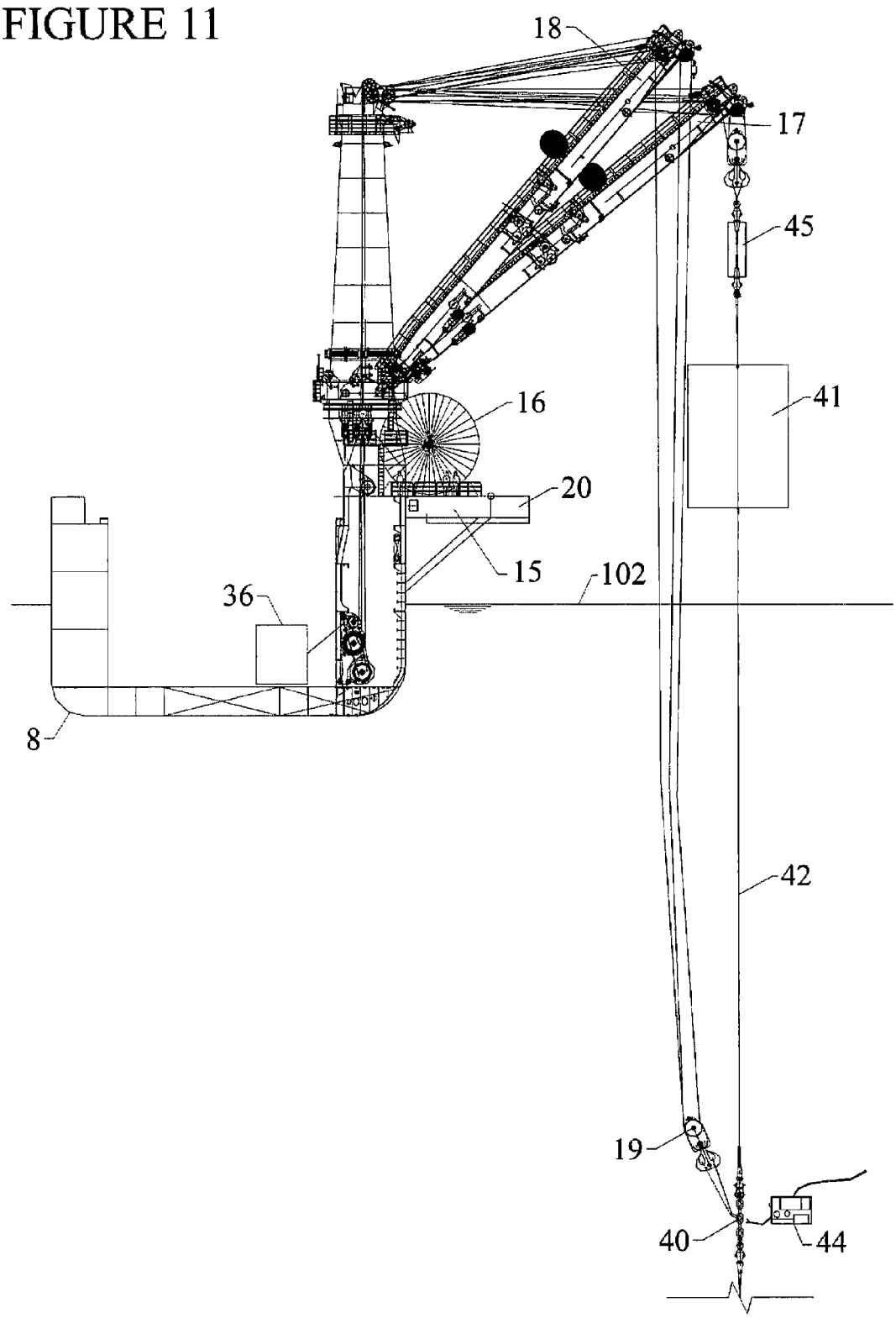
FIG. 11 is a schematic of a floating vessel showing the lowering of the first and second polymer lines with the suction pile and the transferring of the load to the buoy which is supported by the fore crane enabling the suction pile supported by the polymer lines to be lowered into the sea floor.

FIG. 11 shows the fore crane 17 with the buoy 41 in the highest position the fore crane 17 taking the load of the second polymer line 32. The aft crane main block 19 of the aft crane 18, is shown being slack and a remote operated vehicle 44 being used to disconnect the aft crane main block 19 from the polymer line.

The first and second polymer lines connected in series can then be lowered with the suction pile and the load can then be transferred to the buoy which is supported by the fore crane. The first remote operated shackle of the aft crane can then be released and the aft crane main block can be retrieved to the deck of the floating vessel. A suction pile can then be supported by the polymer lines and the fore crane can lower the suction pile into the sea floor.

In an embodiment, the suction pile 26 can also be lowered to the sea floor with the aft crane 18 by placing the heave compensator 45 in the lift rigging. The first polymer line 30 and the second polymer line 32 must suit the water depth for the suction pile to be lowered to the sea floor.

In an additional embodiment, the suction pile 26 with the first polymer line 30 and second polymer line 32 already connected to the buoy 41 can be supported by the fore crane 17 with the heave compensator 45. The polymer lines, buoy, chains and heave compensator must suite the water depth so that the fore crane can sufficiently lower the suction pile 26 into the sea floor for full penetration.

FIG. 12 shows a detail of the suction pile 26 having just been deposited on the sea floor 100 and then sinking into the sea floor under its own weight. Also on this detail the first lift sling 33, the second lift sling 35 and the third lift sling 37, the first remote operated connector 29, the suction pile anchor chain 27 and a side pad eye 31 can be seen.

The suction pile 26 and suction pile anchor chain can be lowered with the fore crane into the sea floor until at least about 0.5 meters to about 1.5 meters of penetration occurs. The remote operated vehicle 44 can include a suction pump 99, which can connect to the suction pile 26. The remote operated vehicle can start its suction pump 99 and the suction pile 26 can be pushed into the sea floor using hydrostatic pressure. In this Figure, the three lift slings are depicted holding the suction pile into a vertical position. This Figure further shows the remote operated connector 29 holding the suction pile anchor chain 27 in an almost vertical position.

Figure 13:
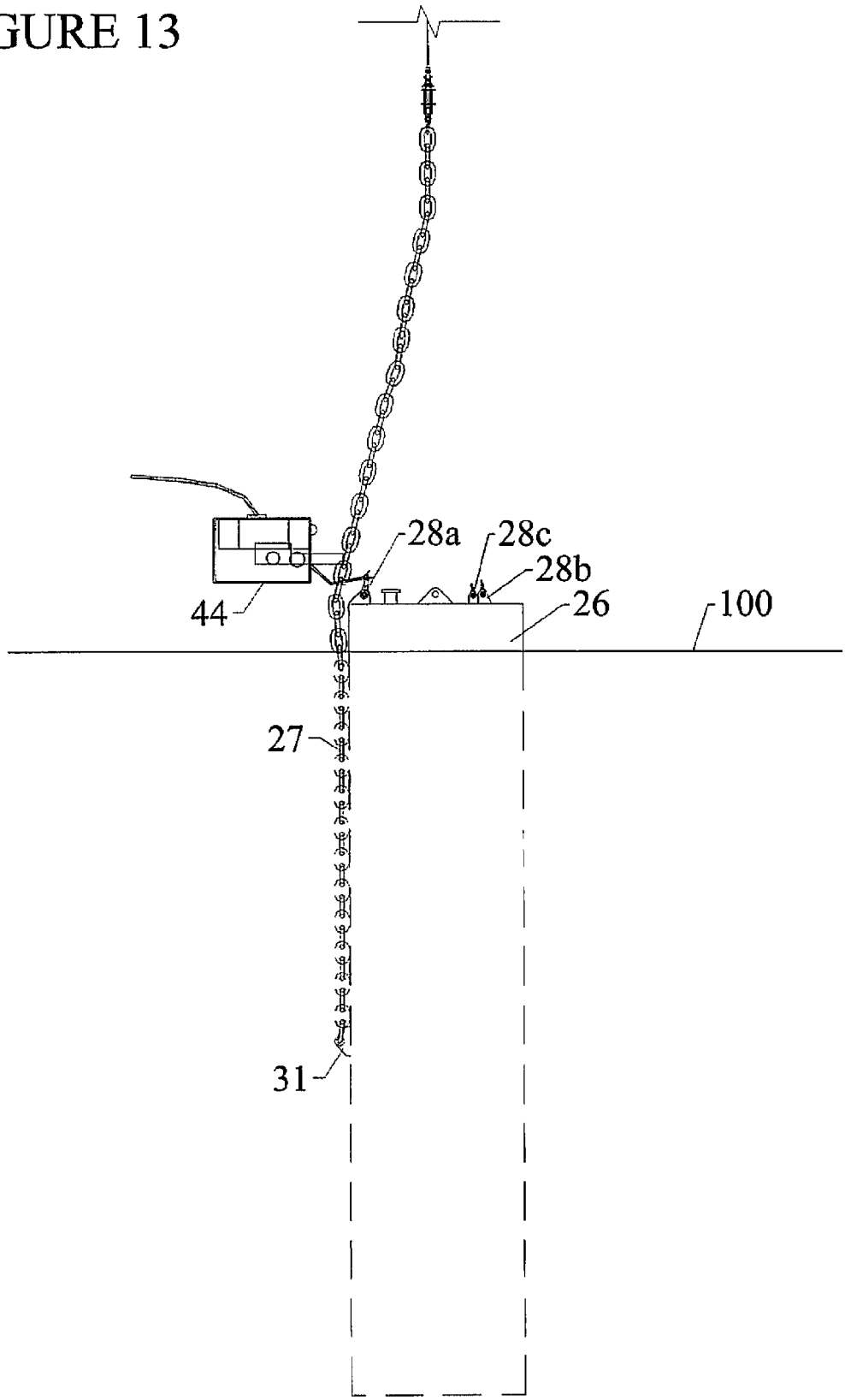
FIG. 13 shows the suction pile sunk into the sea floor and the remote operated vehicle "ROV" for disconnecting the first lift sling, the second lift sling and the third lift sling when suction pile penetration is complete.

FIG. 13 shows a detail of the remote operated vehicle 44 having pumped water out of the suction pile 26 and the suction pile now over about 80 percent sunk into the sea floor 100. Essentially, when the suction pile has reached its required depth into the sea floor, the remote operated vehicle's 44 suction pump can then be disconnected and the lift slings are cut with the remote operated vehicle and the polymer lines with the suction pile anchor chain 27 are now ready to be pre-tensioned.

In additional embodiments, a ballgrab or an alternative connector can be used to connect the suction pile anchor chain to the polymer lines. An example of a ballgrab can be one made by Balltec Ltd. However, any remote operated connector can be used with the system.

In addition, more than two buoys can be in the hold or on the deck of the floating vessel.

It should be noted that more than one deepwater deployment system can be secured in the hold enabling both cranes to lower each crane's main block to water depths of at least about 1500 meters. Each deepwater deployment system can have a winch outfitted with a lifting wire of between about 2000 meters to about 25000 meters which can be guided by sheaves to the crane jib head and lift tackle.

The polymer lines can be made of polyester, Aramide, Kevlar, or a possible composite line, such as a graphite composite material or Dyneema. Any polymer line with neutral buoyancy can be used.

Additionally in an embodiment, when the suction pile is first lowered to the sea floor and allowed to penetrate to a first depth under its own weight, this initial penetration can be between about 0.5 meters to about 1.5 meters. Once the remote operated vehicle pumps out entrapped water from the suction pile, the suction pile has penetrated into the sea floor up to about 80 percent of its body. Any remote operated vehicle can be used to pump out the entrapped water.

While these embodiments have been described with emphasis on the embodiments, it should be understood that within the scope of the appended claims, the embodiments might be practiced other than as specifically described herein.

What is claimed is:

1. A method for deploying a deepwater mooring spread from floating vessel with a bow, stern, hull, deck, an aft crane secured to a port side or a starboard side of the hull having a hold, and a fore crane secured to the port side or starboard side of the hull, comprising:

a. connecting a first suction pile with a suction pile anchor chain while in the hold or on the deck of the floating vessel to a aft crane main block and securing a first lift sling, a second and a third lift sling to the suction pile anchor chain;

b. installing a first polymer line into a reel drive fixedly connected to a load bearing structure with a hang-off, wherein the load bearing structure is affixed to an outboard port side or an outboard starboard side of the floating vessel;

c. lifting the first suction pile forming a lifted suction pile, and hanging the lifted suction pile outboard of the floating vessel using the aft crane;

d. slewing the lifted suction pile adjacent the hang-off and connecting the first polymer line to the suction pile anchor chain of the suction pile;

e. deploying the first polymer line using the reel drive simultaneously while lowering the first suction pile using the aft crane main block to a first depth using the aft crane;

f. connecting the deployed first polymer line to the hang-off;

g. transferring the first suction pile from the aft crane main block to the first polymer line supported by the hang-off;

h. releasing the aft crane main block from the first suction pile and suspending the suction pile from the first polymer line connected to the hang-off;

i. connecting a second polymer line to the first polymer line at the deck;

j. lifting the first polymer line from the hang-off with a load of the suction pile using the aft crane;

k. deploying the second polymer line using the reel drive and lowering the first suction pile supported by the first polymer line to a second water depth using a deepwater deployment system connected to the aft crane;

l. connecting the second polymer line to the hang-off;

m. transferring the load from the suction pile and the first polymer line to the second polymer line and connecting the second polymer line to the hang-off and retrieving the aft crane main block to the deck;

n. deploying additional polymer lines and transferring suction pile loads in a similar manner until the suction pile reaches a sea floor;

o. lifting a first buoy with a first buoy chain from the hold or deck using the fore crane and orienting the first buoy adjacent to an end of a last polymer line deployed;

p. overboarding the first buoy with the fore crane and connecting the first buoy chain to the end of the last deployed polymer line;

q. allowing the suction pile to penetrate into the sea floor using a weight of the suction pile and lowering the suction pile by the aft crane or fore crane;

r. pumping out water from the suction pile with an remote operated vehicle to penetrate the suction pile into the sea floor;

s. disconnecting the fore crane from the buoy; and t. repeating steps (a) to (t) to deploy additional suction piles and buoys using polymer lines creating a deepwater mooring spread with mooring lines having close to neutral buoyancy.

2. The method of claim 1, wherein the polymer line is a fiber line of any kind with a density close to the density of seawater.

3. The method of claim 1, wherein between 1 suction pile and 18 suction piles are deployed to a water depth of at least 1000 meters.

4. The method of claim 1, further comprising using a remote operated shackle with each suction pile for lifting the suction pile using the aft crane.

5. The method of claim 1, further comprising using at least one connector.

6. The method of claim 1, wherein a plurality of suction piles are disposed in a hold in a vertical orientation of the floating vessel, or in a horizontal or a vertical position on a deck of another floating vessel.

7. The method of claim 1, further comprising using a heave compensator unit to limit the loads using one or both cranes while orienting and lowering the suction pile.

* * * * *